US006089960A

United States Patent [19]

Messer

[11] Patent Number: 6,089,960

[45] Date of Patent: Jul. 18, 2000

[54] SEMICONDUCTOR WAFER POLISHING MECHANISM

[75] Inventor: Rick Messer, Austin, Tex.

[73] Assignee: One Source Manufacturing, Austin, Tex.

[21] Appl. No.: 09/089,683

[22] Filed: Jun. 3, 1998

[51] Int. Cl.[7] ..... B24B 29/00

[52] U.S. Cl. ..... 451/285; 451/398

[58] Field of Search ..... 451/287, 288, 451/289, 398, 388, 8, 41

[56] References Cited

U.S. PATENT DOCUMENTS

| | | | |
|---|---|---|---|
| 4,194,324 | 3/1980 | Bonora et al. | 51/131.5 |
| 4,270,314 | 6/1981 | Cesna | 51/131.4 |
| 5,216,846 | 6/1993 | Takahashi | 51/326 |
| 5,421,770 | 6/1995 | Bobst | 451/390 |
| 5,423,558 | 6/1995 | Koeth et al. | 279/3 |
| 5,482,379 | 1/1996 | Harris et al. | 384/208 |
| 5,651,724 | 7/1997 | Kimura et al. | 451/41 |
| 5,762,424 | 6/1998 | Harris et al. | 384/299 |
| 5,839,947 | 11/1998 | Kimura et al. | 451/288 |
| 5,868,609 | 2/1999 | Aaron et al. | 451/285 |
| 5,899,798 | 5/1999 | Trojan et al. | 451/259 |

*Primary Examiner*—Timothy V. Eley
*Assistant Examiner*—Dung Van Nguyen
*Attorney, Agent, or Firm*—Kelly K. Kordzik; Winstead Sechrest & Minick P.C.

[57] ABSTRACT

A wafer polishing machine uses a pedestal unit that holds a semiconductor wafer using a vacuum force for polishing the surface of the wafer on a polishing pad and slurry mixture. A gimbal mechanism is implemented within the pedestal unit so that the various portions of the wafer surface are evenly polished. The gimbal mechanism enables the portion of the pedestal unit holding the semiconductor wafer to precess relative to that portion of the pedestal unit connected to the polishing machine. An elastomeric shim ring is also used within the pedestal unit to provide further compliance of the wafer surface to the various contours of the polishing pad during the polishing process.

18 Claims, 13 Drawing Sheets

(Bolts Holding Parts and Assemblies Together Not Shown)

Cross-section of Assembled Prior Art Gimbal Mechanism

Note: The Prior Art Gimbal Can Not Rotate on the X or Y Axis Line Meaning it Can Rotate About the X and Y Axis But Not Along the Axis Line Thus Preventing Rotation on the +/- X & +/- Y Axis Lines

SEMICONDUCTOR WAFER POLISHING MECHANISM

TECHNICAL FIELD

The present invention relates in general to semiconductor manufacturing, and in particular, to chemical-mechanical polishing of a semiconductor wafer surface.

BACKGROUND INFORMATION

The manufacturing of an integrated circuit ("chip") involves numerous steps, all critical to the successful implementation of the desired circuitry within each chip. The process begins with very large single crystals being grown and then sliced into wafers for subsequent processing. The wafer is a large single crystal of semiconductor material that is used as the substrate during the manufacture of a number of chips sliced from the processed wafer. Circuitry is then built onto the substrate in a plurality of steps. The number of viable chips that can be produced from a single wafer not only depends on the size and complexity of the circuits or components on the chips, but also depends upon the quality of the various manufacturing steps applied to the wafer and the purity of the environment in which the steps are performed.

One or more of the steps involved in the process is a chemical-mechanical polishing process where chemical agents and abrasives work jointly on the wafer surface to produce a mirror finish and to polish the circuitry deposited and formed on the wafer in preparation for the next step in the process. This chemical-mechanical polishing involves attaching a wafer to a machine with a motor that rotates the wafer onto a polishing pad immersed in a polishing slurry. One such mechanism is illustrated in FIG. 1 as chemical-mechanical polishing unit 100. The pad and slurry 102 is placed within a platter 104, and the wafer (not shown) is attached through suction created by a vacuum within unit 103 to the bottom of pedestal 101. Pedestal 101 then lowers the wafer surface onto the slurry pad 102 and begins rotating and moving the pedestal and attached wafer around within the slurry pad 102.

One of the challenges with this process is to polish the wafer surface uniformly. The more uniform the polishing process, the less the failure rate of the various chips sliced from the wafer.

Referring to FIGS. 2A–2E, there is illustrated prior art pedestal 200, which employs a gimbal assembly 202 in an attempt to ensure that the wafer surface is uniformly applied to the polishing slurry so that the polishing of the wafer surface is subsequently as uniform as possible. FIG. 2A illustrates a cross-section of prior art gimbal assembly 202.

Pedestal unit 200 essentially comprises three primary members: the tapered housing 201, the gimbal assembly 202, and the fluid distribution and force transmitting housing 203. The tapered housing 201 is physically attached (e.g., screwed) to unit 103, and is pivotally attached to center portion 212 of gimbal assembly 202. Force transmitting housing 203 is attached (e.g., screwed) to inner ring 212 of the gimbal assembly 202. Gimbal assembly 202 is screw-attached to tapered housing 201 through gimbal ring portion 210. A wafer holding mechanism (not shown) is then attached to the underside of housing 203 to hold the semiconductor wafer (not shown) under the vacuum force created by unit 103 and transmitted through the center 250 of pedestal unit 200.

As a rotational force is applied by polishing unit 103 to tapered housing 201, the entire pedestal unit 200 is also rotated, thus rotating the semiconductor wafer (not shown) within the slurry pad 102. However, as discussed above, if pedestal unit 200 was completely rigid (no gimbal assembly), some portions of the semiconductor wafer would be polished more than others, resulting in a non-uniform polishing of the semiconductor wafer surface, which would result in a higher failure rate for certain ones of the chips sliced from the semiconductor wafer. The prior art attempts to address this problem with gimbal assembly 202. FIG. 2B illustrates how gimbal assembly 202 is assembled, while FIG. 2C illustrates a top view of gimbal assembly 202, and FIG. 2D illustrates a perspective view of gimbal assembly 202.

The problem with gimbal assembly 202 is that it falls short of enabling the semiconductor wafer surface to be polished as uniformly as possible. The reason for this is how the gimbal assembly 202 is made. Center portion 212 pivots on the X axis created by shafts 215 and 216 relative to middle portion 211. Likewise, middle portion 211 pivots along a Y axis created by shafts 213 and 214 relative to outer ring 210. An example of such pivoting is further illustrated in FIG. 2E. As can be appreciated, if the wafer is in fixed relationship to center portion 212, and the tapered housing 201 is in fixed relationship to outer ring 210, there will be portions of the semiconductor wafer that will have greater pressure applied to them relative to the slurry pad 102 than other portions. Not only does this result in less uniformity in the polishing process, but the center and outer edge surfaces of the wafer are not polished, thus wasting these portions of the semiconductor wafer. Considering the relatively high cost of chips, especially microprocessors, wasted portions of a semiconductor wafer result in lost revenue.

Therefore, there is a need in the art for a wafer polishing mechanism that provides for more uniform polishing of the semiconductor wafer surface and polishes more surface area on the semiconductor wafer, such as the center portion and the outer edge.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 3A:
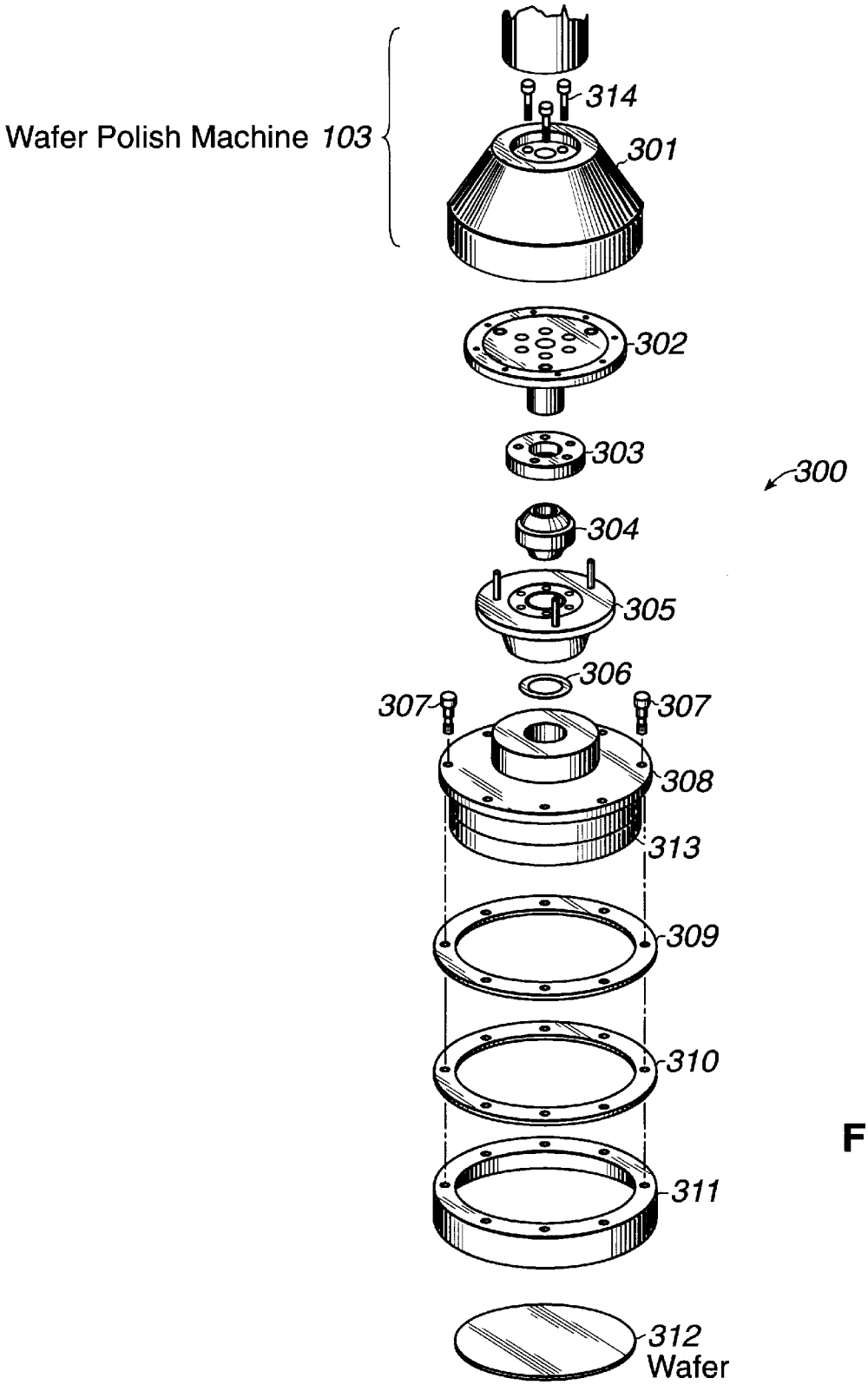
FIGS. 3A–3N illustrate a polishing mechanism in accordance with the present invention.

FIG. 3A illustrates an exploded view of the various parts of polishing mechanism 300 in accordance with the present invention. One aspect of the present invention replaces gimbal assembly 202 with a ball and socket mechanism 304 that allows the fluid distribution and force transmitting housing 308 to conform to the attitude of the wafer 312 without limitations, as described with respect to the prior art gimbal assembly 202, as the wafer 312 is forced against the polishing surface (slurry pad 102) by the rotation and pushing action of the total machine through the tapered housing 301. The limitations placed on the operation of gimbal assembly 202, namely the shafts 213–216, are not present with the ball and socket assembly 304.

Figure 3B:
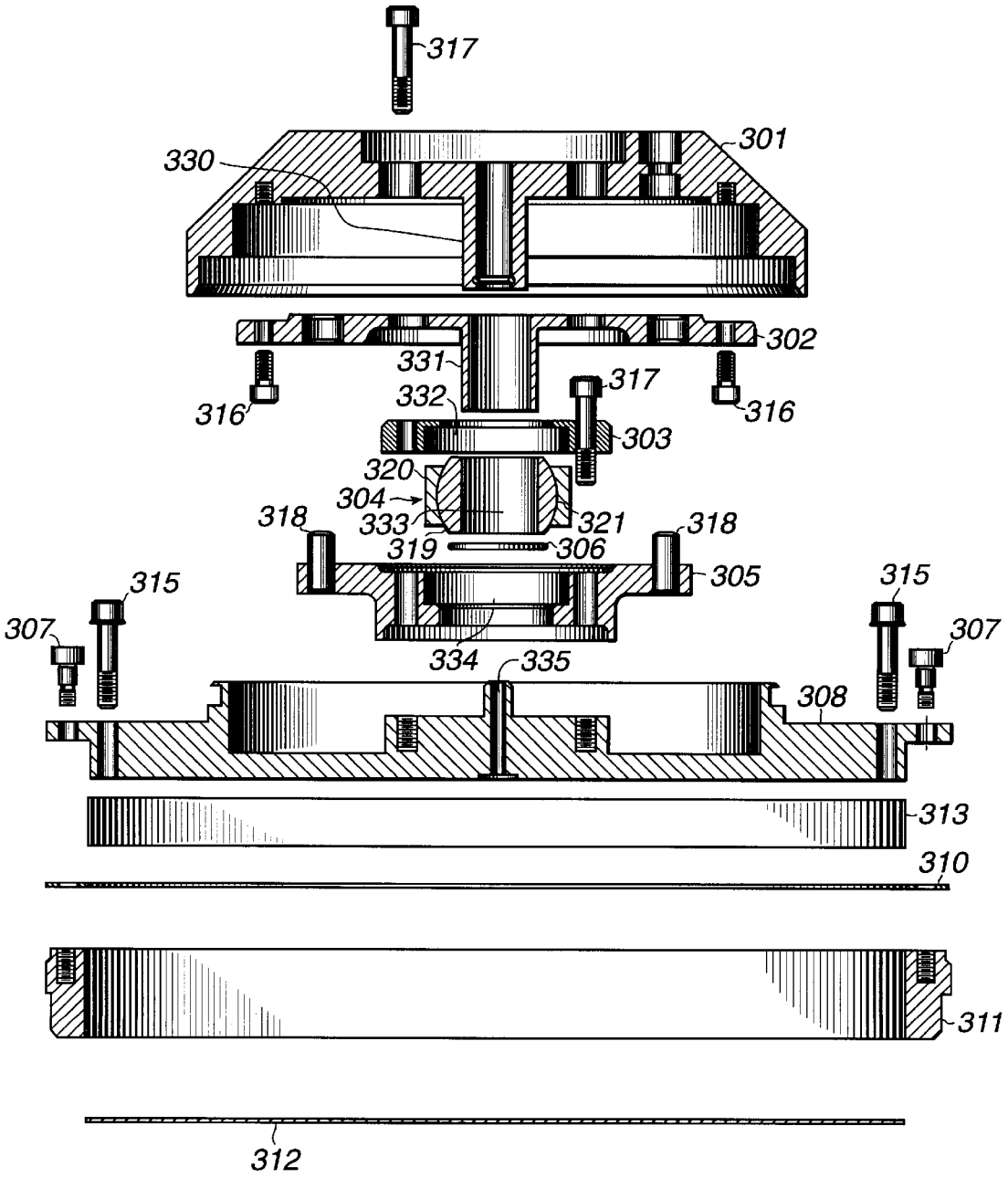
Figure 3C:
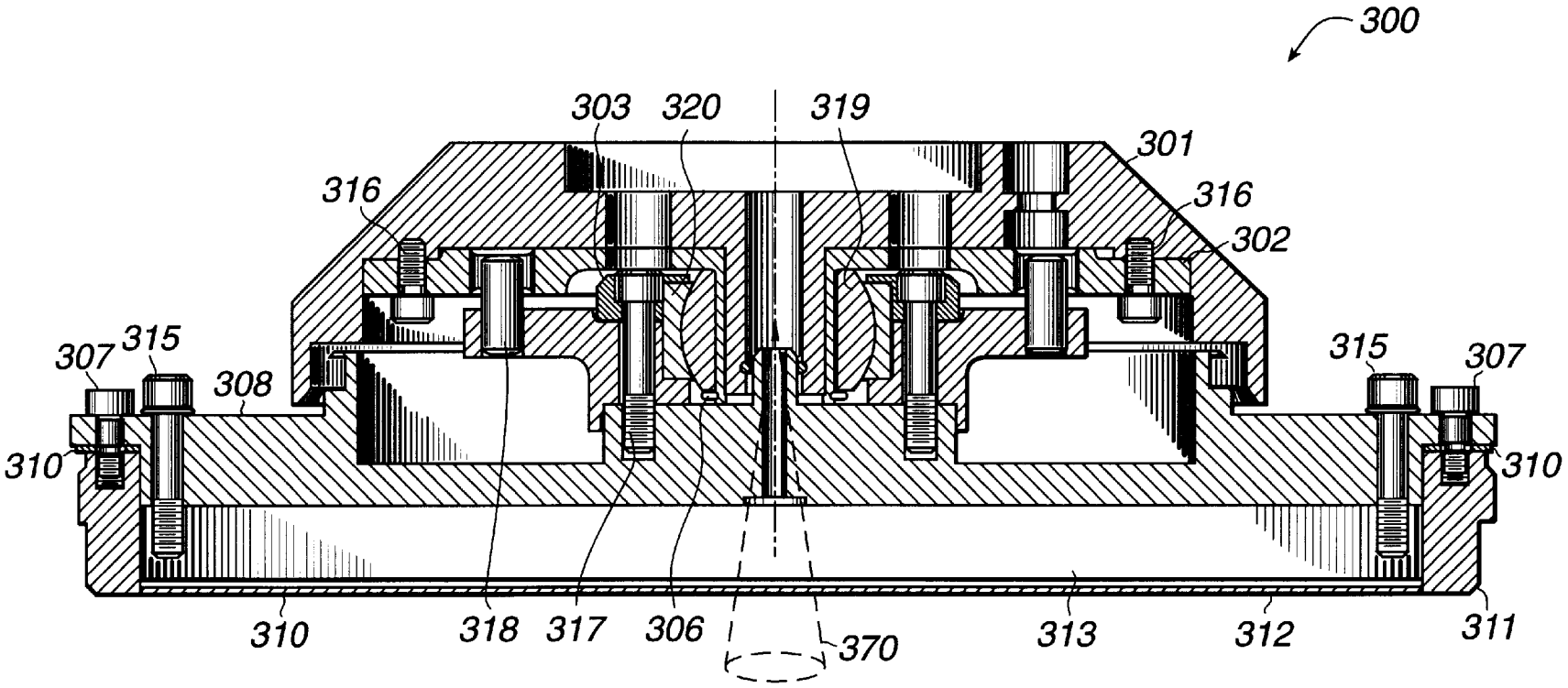

Referring to FIGS. 3A–3C, the polishing mechanism 300 will be described in more detail. Tapered housing 301 is adaptable for connecting to polishing unit 103 using pins 314 and bolts (not shown). Tapered housing 301 couples to torque transmitting disk 302, which is connected to tapered housing 301 using bolts 316. Centered and hollow stem 330 within housing 301 fits through the hollow portion of stem 331, which is assembled through centers 332, 333, and 334. Stem 331 also passes through the center hole within retaining ring 306. The center hollow portions of all of these parts, along with hollow tube 335 in fluid distribution and force transmitting housing 308 provide for the provision of a vacuum force all the way through from unit 103 in order to "grab" wafer 312. Torque drive ring 302 provides torque to bearing race support ring 305 through torque transmitting pins 318. When the invention 300 is assembled, torque drive ring 302 is coupled to ball 319 of spherical bearing 304. Spherical socket 320 of bearing 304 is placed in fixed relationship to bearing race clamp ring 303, bearing race support ring 305 and force transmitting housing 308. These parts are coupled using bolts 317. Socket ring 320 is permitted to spherically rotate in relation to ball 319, which spherical rotation action is enhanced by a teflon coating 321 between the two parts.

Force transmitting housing 308 is bolted by bolts 315 to fluid distribution pad and vacuum chuck 313, the bottom of which is placed in contact with wafer 312 when the vacuum force through unit 103 is activated. Wafer 312 fits within the inter-diameter of extension ring 311 so that wafer 312 does not slide around on the lower surface of pad 313.

Another unique feature of the present invention is the implementation of one or more elastomeric shim rings 309 and 310, which provides an elastic boundary between housing 308 and extension ring 311 when these two are bolted together using height setting screws 307. The elasticity of the shim ring(s) 309, 310 provides further compliance of the surface of the semiconductor wafer relative to the polishing pad and slurry 102 to assist in the more uniform polishing of the semiconductor wafer surface 312. Furthermore, due to all the variables in the wafer carrier 300 building process, and given the tight tolerances that need to be maintained, the shim(s) 309, 310 allow for some degree of adjustment and relief. The use of one or more shim(s) 309, 310 compensates for the variables in the manufactured dimensions of the shim(s) 309, 310, force transmitting housing 308, vacuum chuck 313, and extension ring 311. The compressive qualities of the elastomeric shim ring(s) 309, 310 makes it easy to maintain the final product extension without sacrificing the integrity of the product. In other words, for example, if one sector of the vacuum chuck 313 (or any of the other parts) is not exactly as thick as the other sectors, then the shim ring(s) 309, 310 will allow the other sectors to be adjusted using the height setting screws 307 to ensure that the bottom surface of the wafer 312 is ideally positioned with respect to the lower outer ring edge of extension ring 311. Without the use of the shim ring(s) 309, 310, if one particular sector of the vacuum chuck 313 had less of a thickness than the other sectors, then the surface of the semiconductor wafer 312 positioned over that sector of vacuum chuck 313 will be positioned too far up into extension ring 311, whereby the outer ring of extension ring 311 will touch the polishing pad and slurry 102 before that portion of wafer 312, which will result in an uneven polishing of that portion of wafer 312 relative to the other portions of the wafer 312.

Figure 3D:
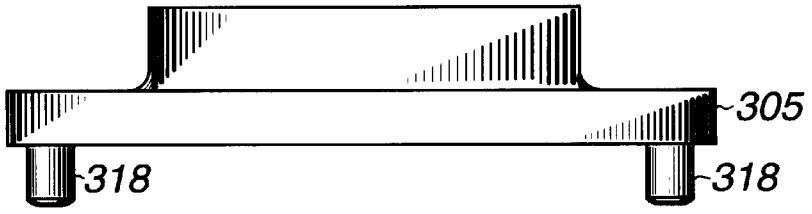
Figure 3E:
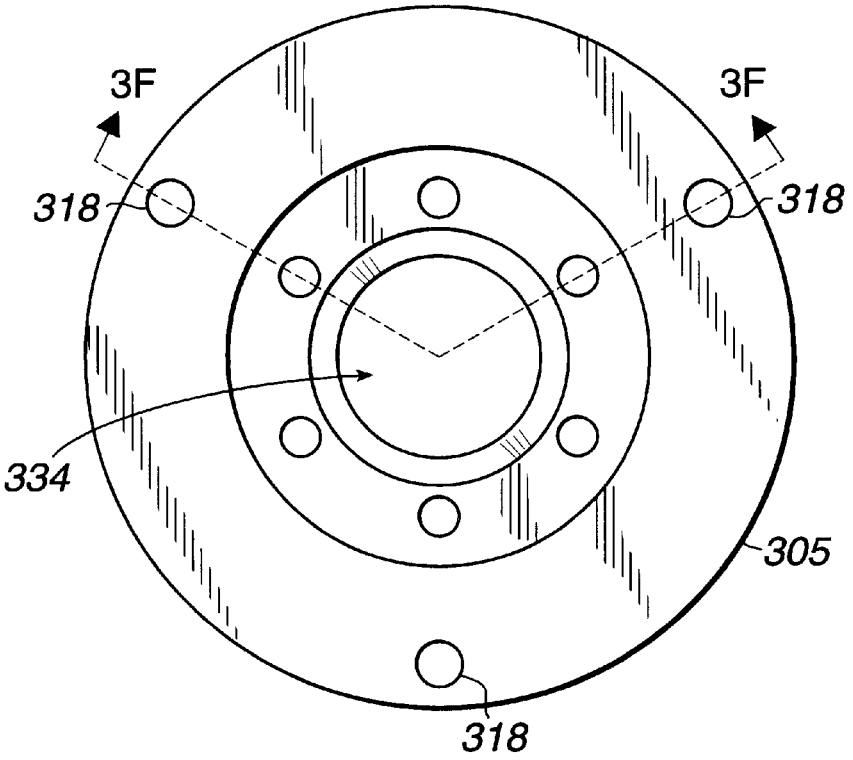
Figure 3F:
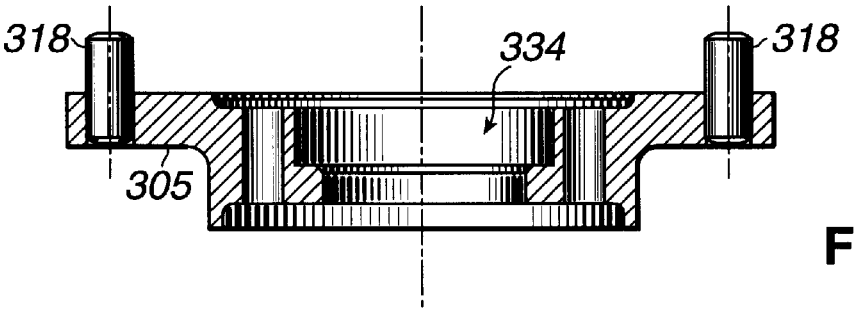

FIGS. 3D–3F illustrate further detail of bearing race support ring 305. FIG. 3D illustrates a side view of support ring 305. FIG. 3E illustrates a top view of support ring 305. FIG. 3F illustrates a cross-sectional view of support ring 305.

Figure 3G:
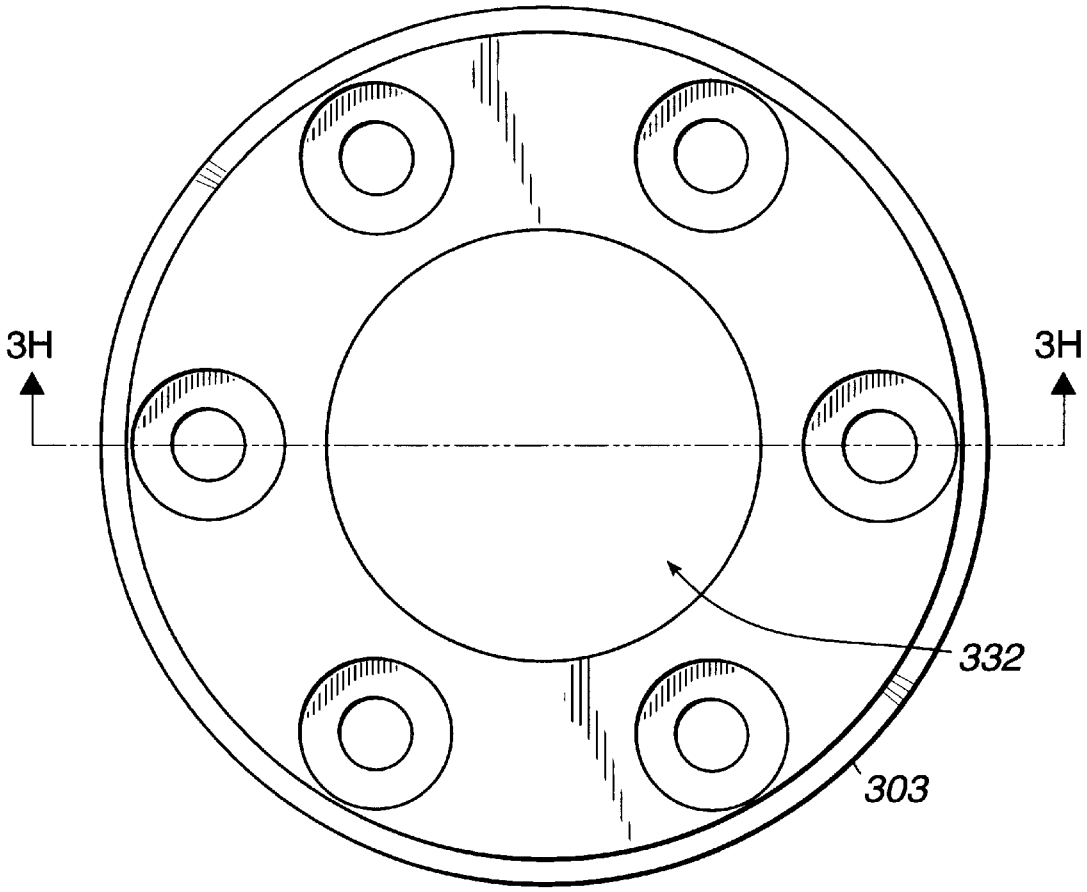
Figure 3H:
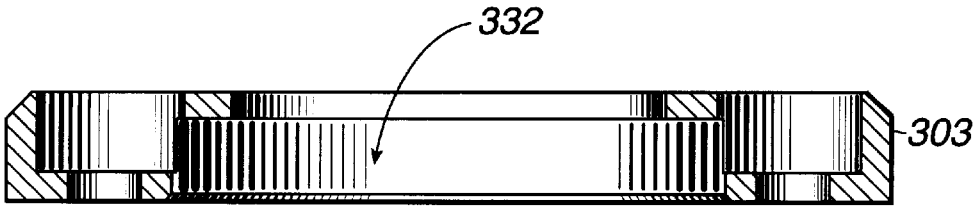

FIGS. 3G and 3H illustrate further detail of bearing race clamp ring 303. FIG. 3G illustrates a top view of clamp ring 303, while FIG. 3H illustrates a cross-sectional view of clamp ring 303.

Figure 3I:
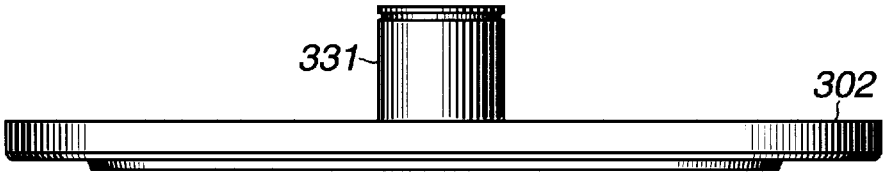
Figure 3J:
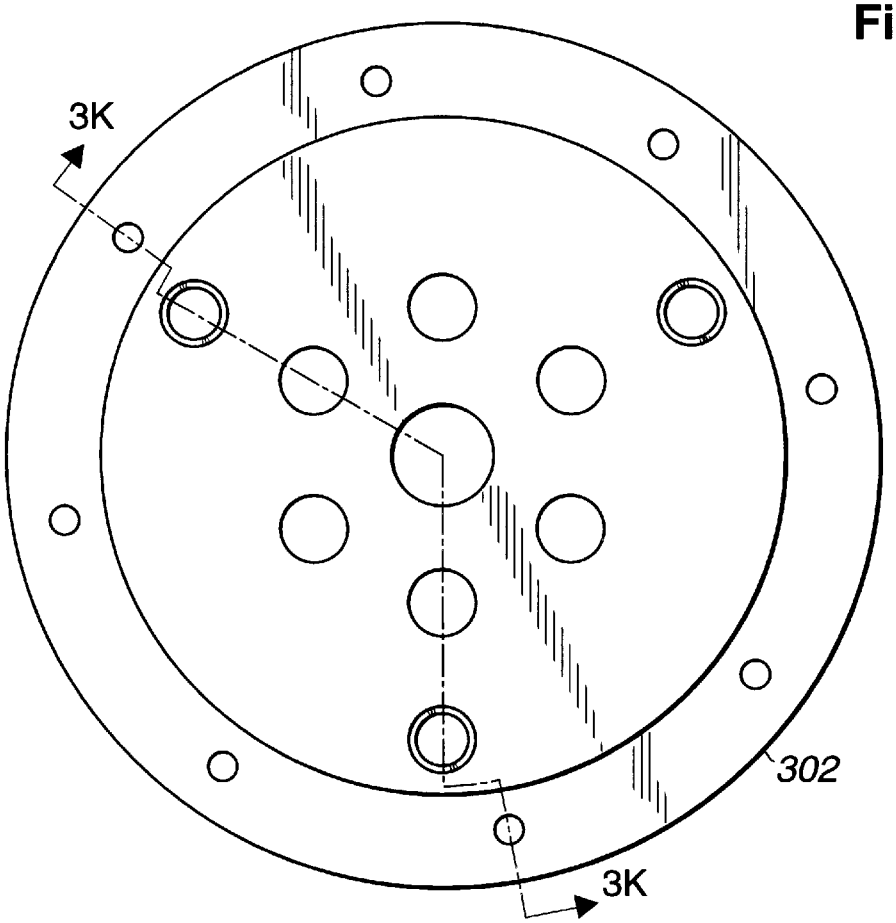
Figure 3K:
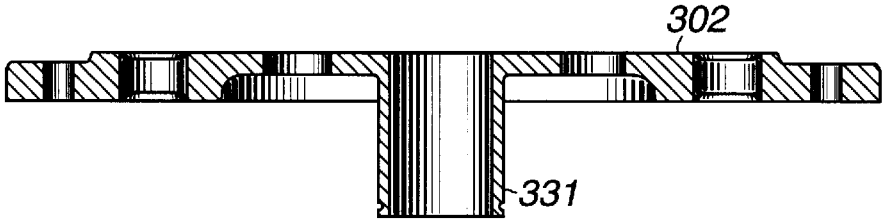

FIGS. 3I–3K illustrate further detail of bearing ball shaft and torque drive ring 302. FIG. 3I illustrates a side view of drive ring 302. FIG. 3J illustrates a top view of drive ring 302. FIG. 3K illustrates a cross-sectional view of drive ring 302.

Figure 1:
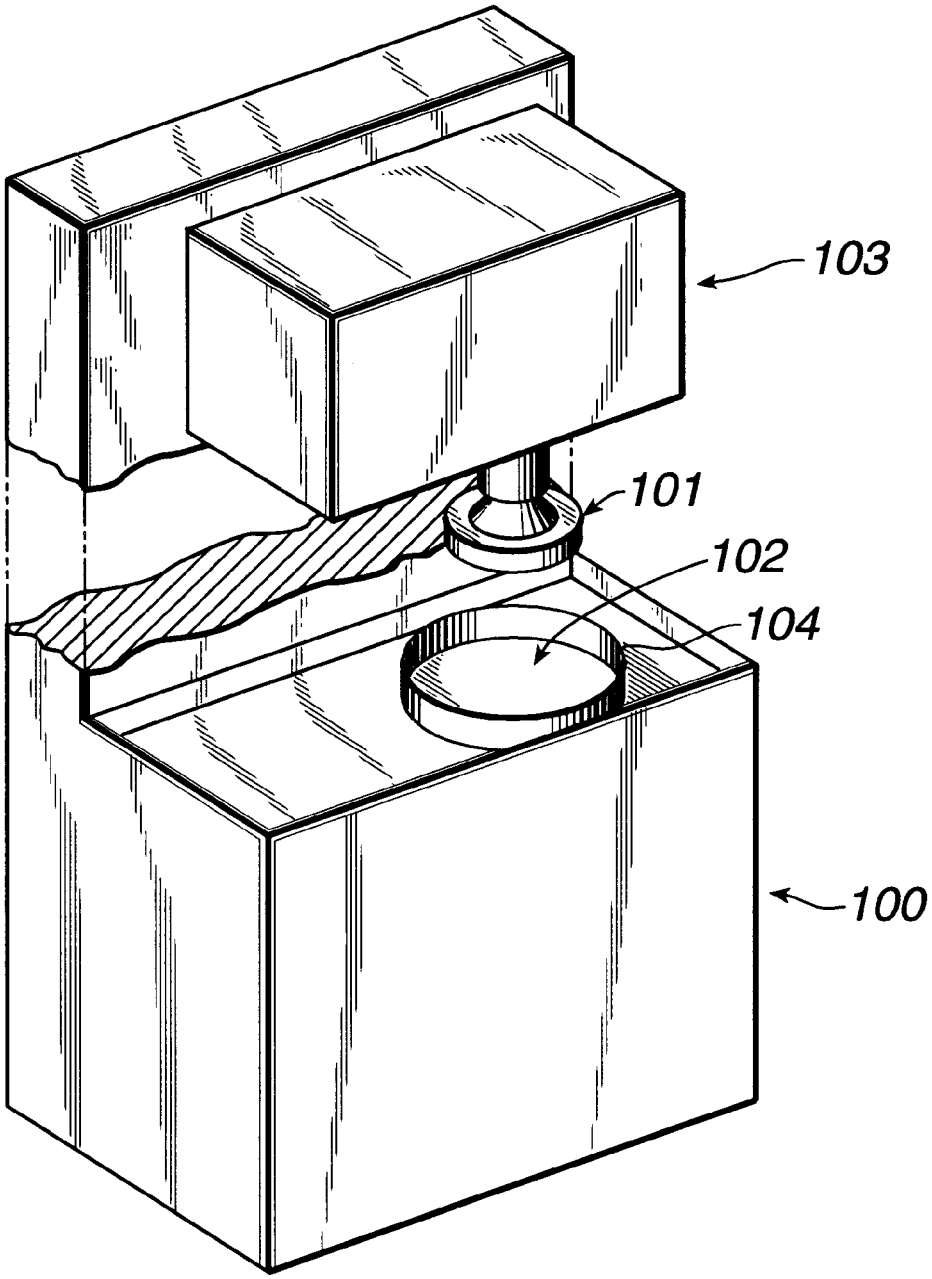
FIG. 1 illustrates a unit for performing chemical-mechanical polishing of a semiconductor wafer.
Figure 2A:
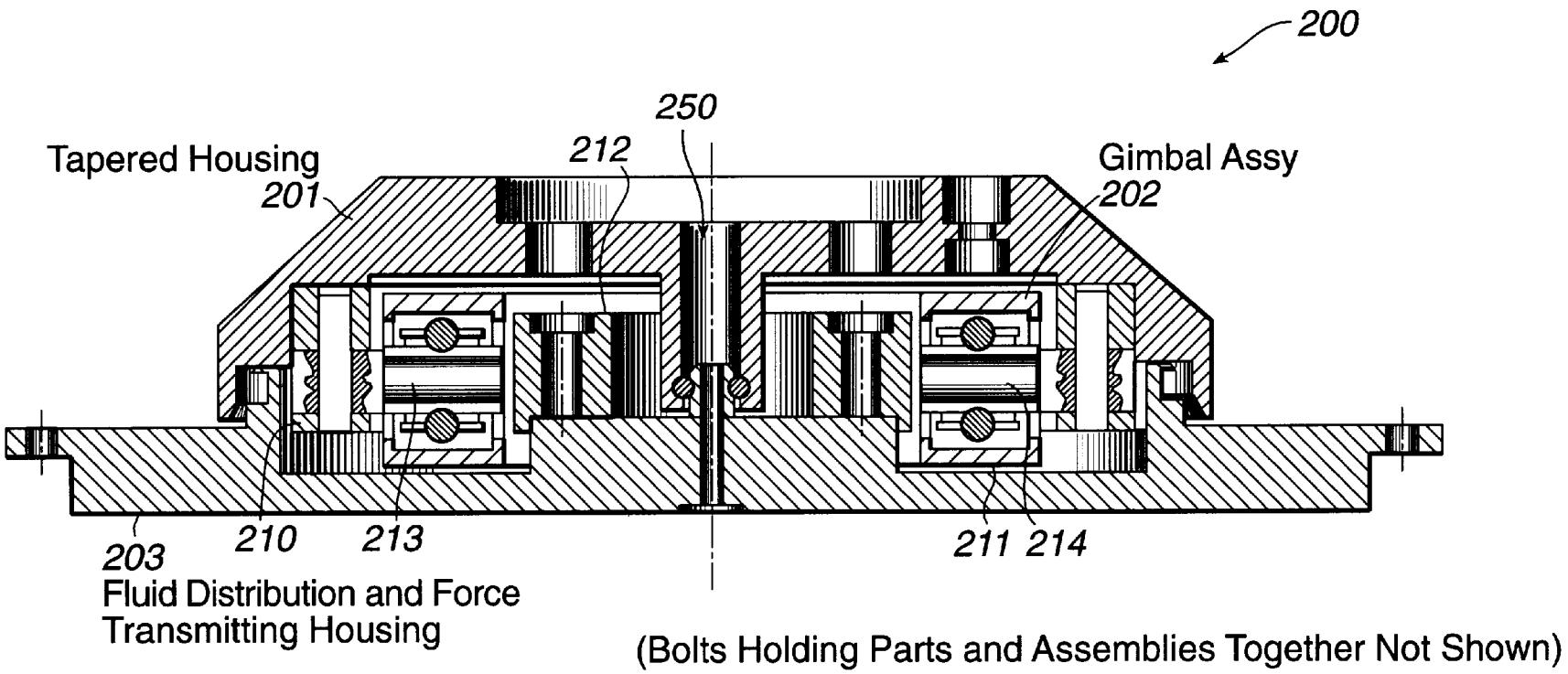
Fig. 2A Prior Art
FIGS. 2A–2E illustrate a prior art mechanism for polishing a semiconductor wafer.
Figure 2B:
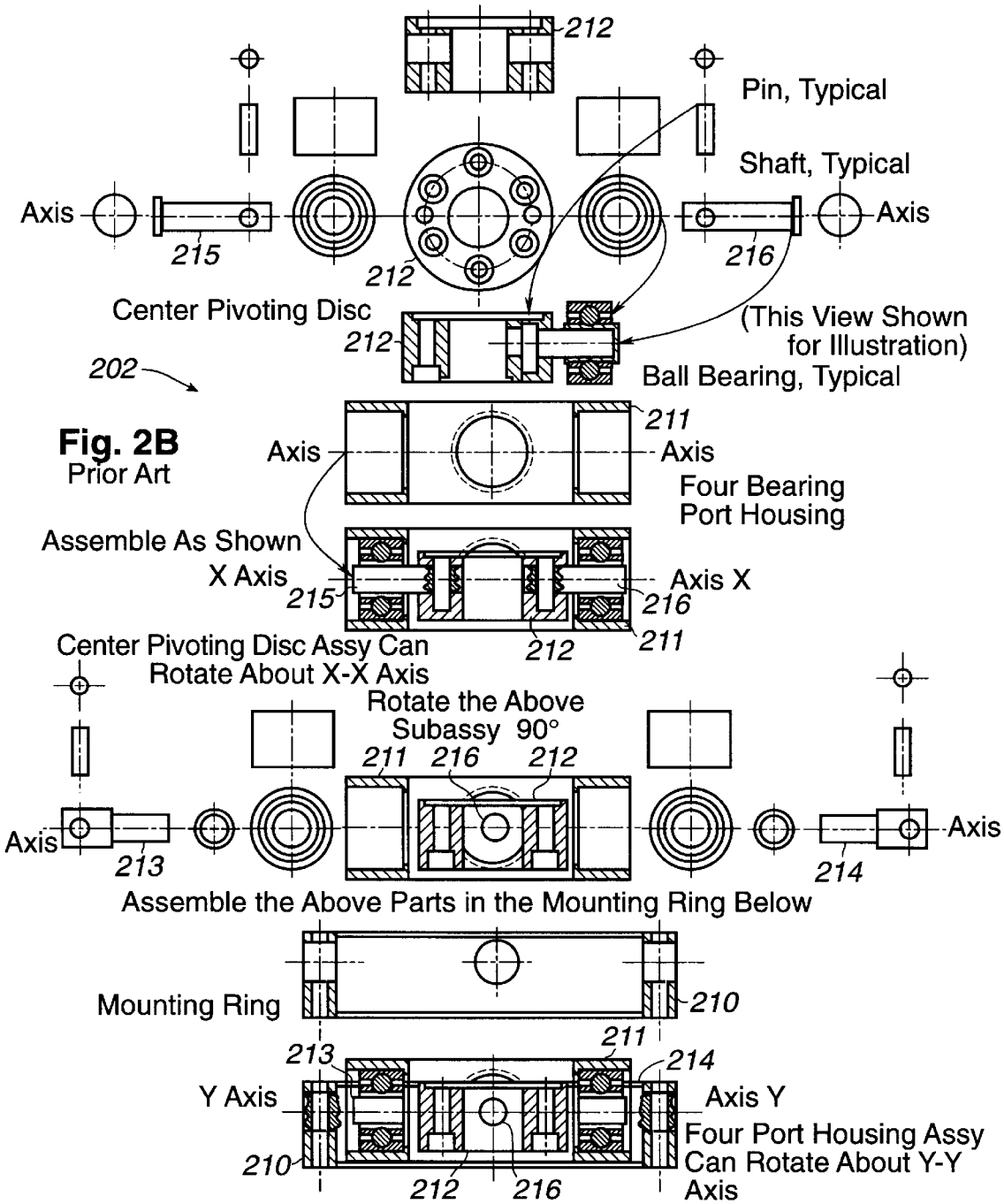
Fig. 2B Prior Art
Figure 2C:
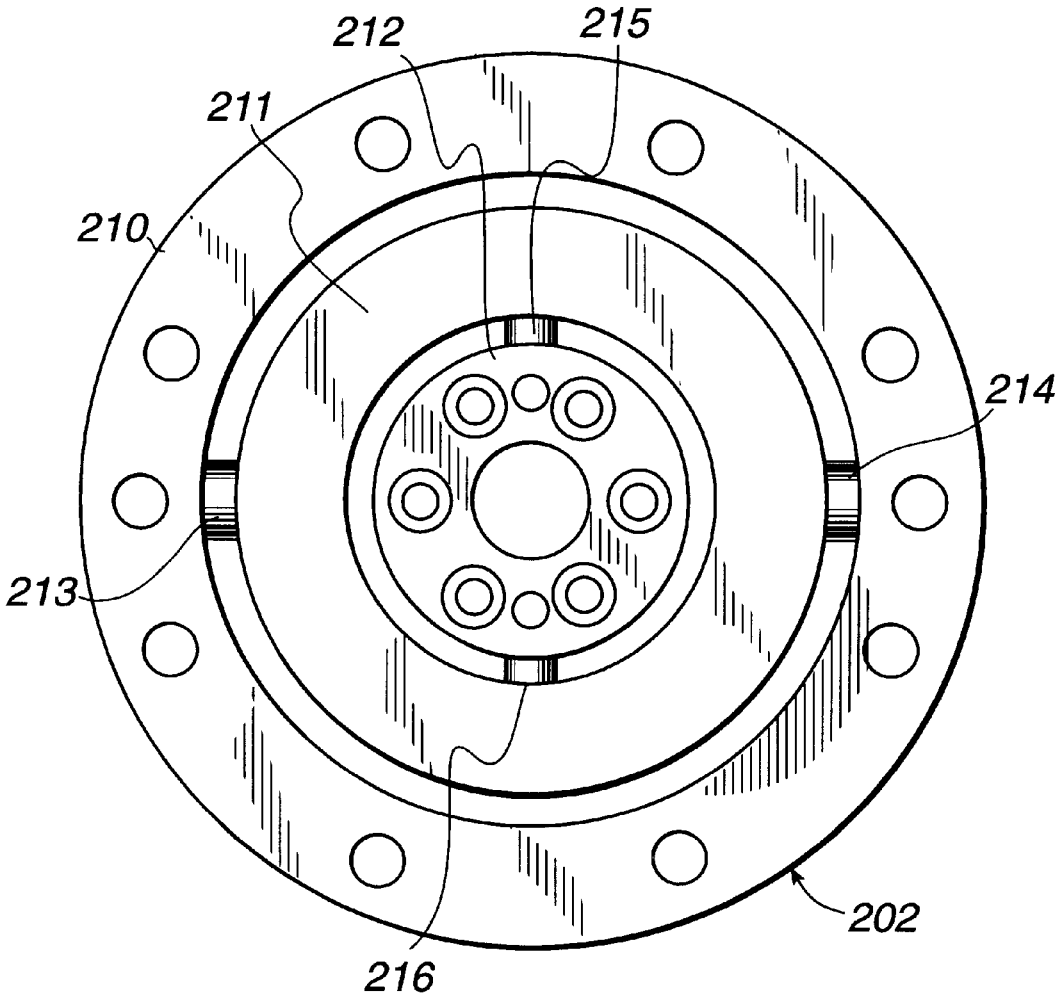
Figure 2D:
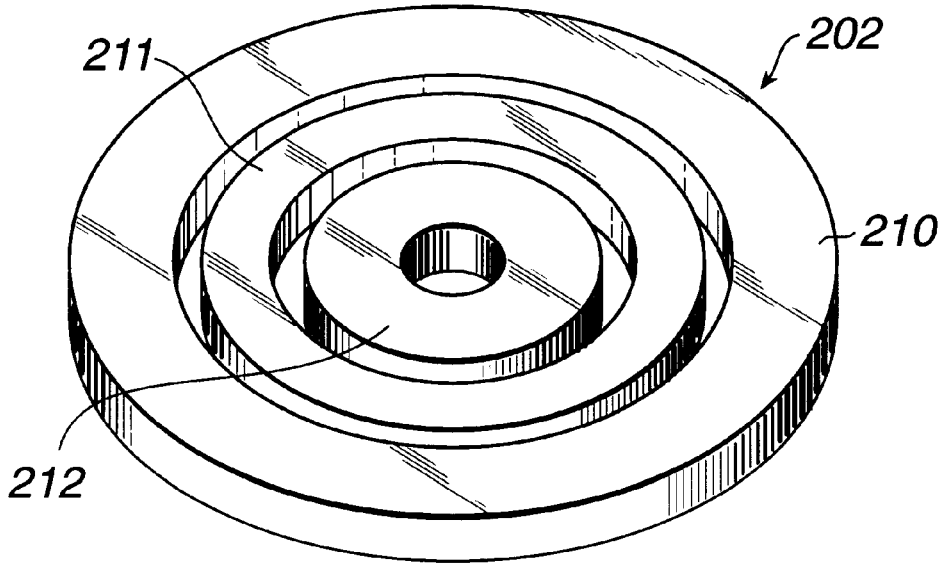
Figure 2E:
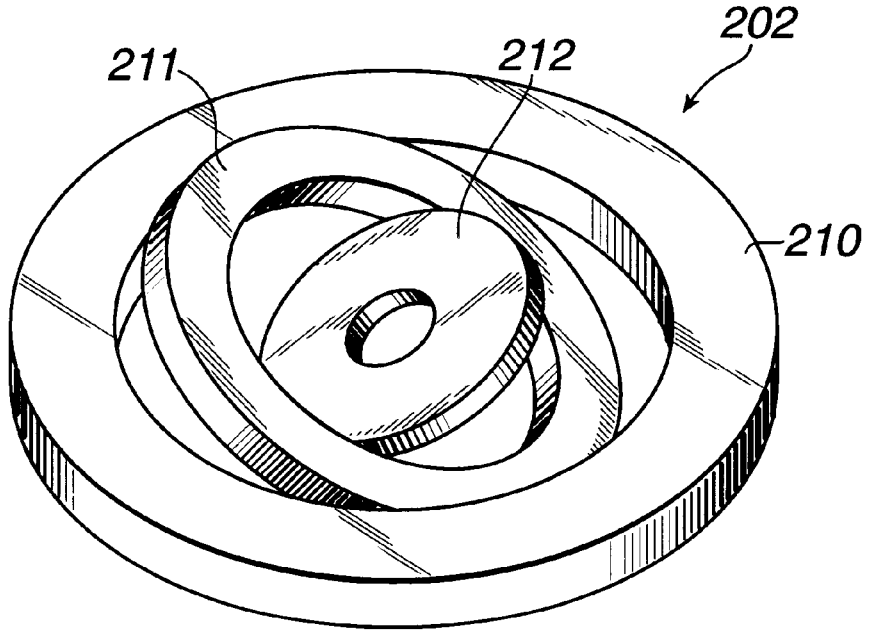
Figure 3L:
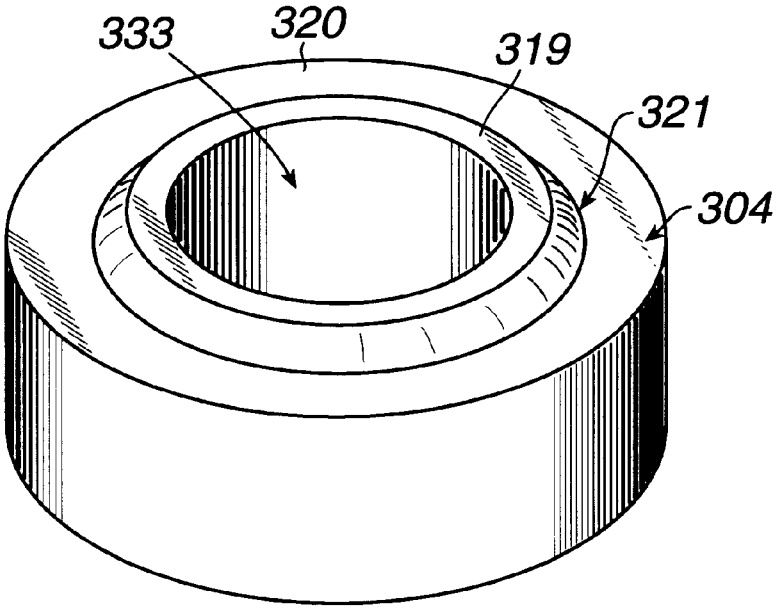
Figure 3M:
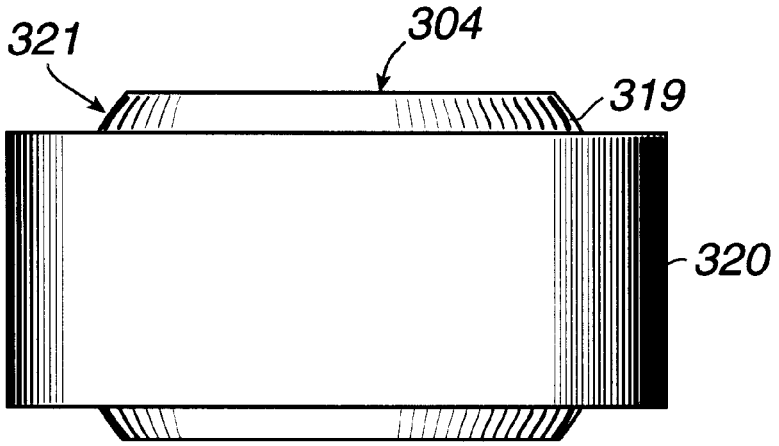

FIGS. 3L–3M illustrate further detail of spherical bearing 304. As can be readily appreciated, any side of outer ring 320 is permitted to spherically rotate around relative to ball portion 319, without any limitation, such as caused by shafts 213–216 within prior art gimbal mechanism 202. A teflon liner 321 is disposed at the boundary where ball portion 319 contacts outer ring 320 to limit friction. Spherical bearing 304 permits that portion of mechanism 300 comprising parts 303, 305, 308, 313, 309, 310, 311, and wafer 312 to precess relative to that portion of mechanism 300 comprising parts 301 and 302, which also allows a normal line to the surface of the semiconductor wafer 312 to precess relative to the polishing surface. In this context, precess refers to the gyration of the rotation axis of a spinning body about another line intersecting it so as to describe a cone caused by the application of a torque tending to change the direction of the rotation axis. Such a possible precession is shown by cone 370 in FIG. 3C. The prior art gimbal mechanism illustrated in FIGS. 2A–2C would not be able to precess.

Figure 3N:
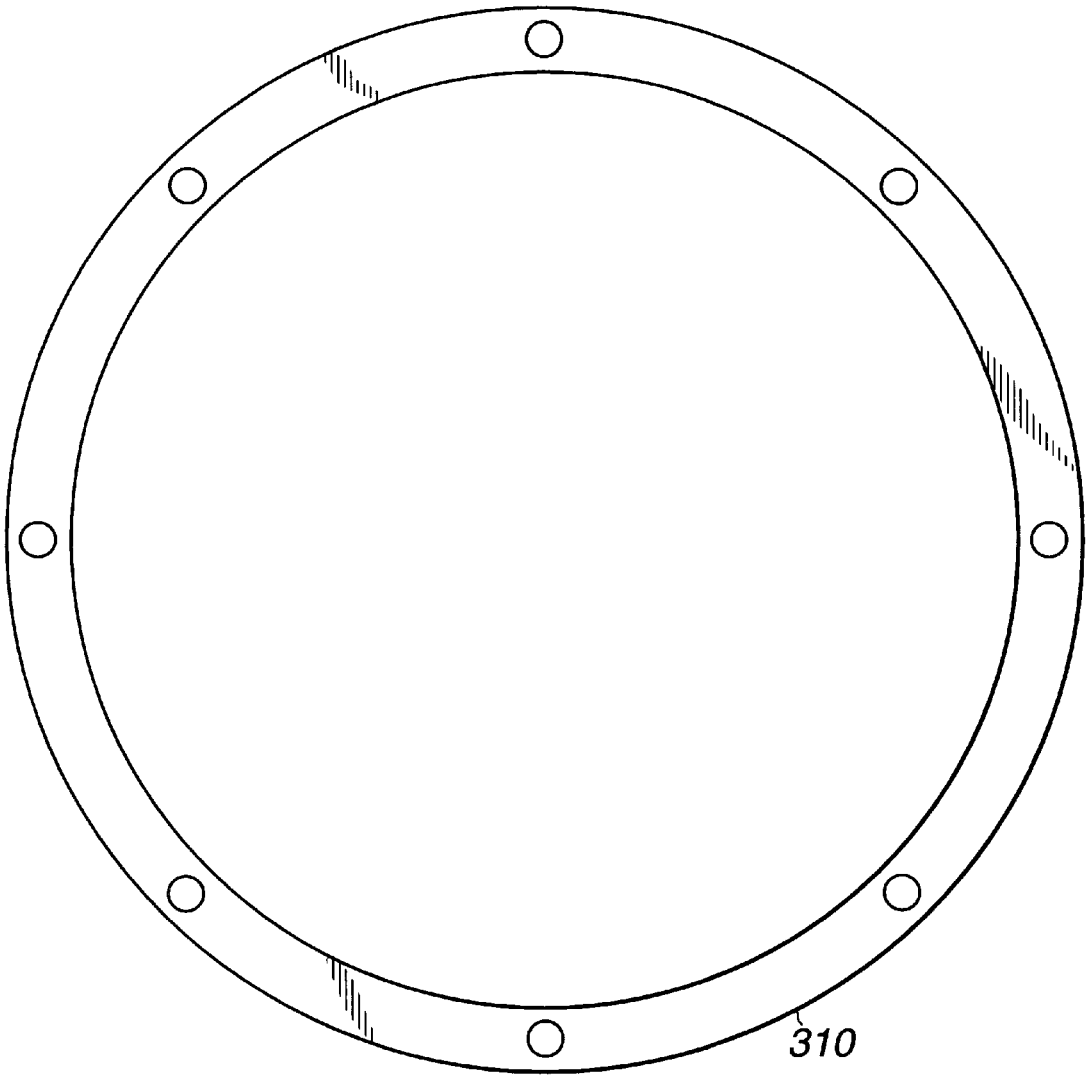

FIG. 3N illustrates further detail of elastomeric shim ring(s) 309, 310.

Shim ring(s) 309, 310 may be made of a silicone material, rubber or any equivalent material having elastomeric properties, and has an ability to contract at specific locations so that the extension ring 311 can move relative to the force transmitting housing 308 so that the position of the wafer surface can better conform to the contours of the polishing pad.

Although the present invention and its advantages have been described in detail, it should be understood that various changes, substitutions and alterations can be made herein without departing from the spirit and scope of the invention as defined by the appended claims.

What is claimed is:

1. A semiconductor wafer polishing apparatus, comprising:

a first housing adaptable for coupling to a wafer polishing machine;

a second housing adaptable for holding a semiconductor wafer; and a bearing, coupled to the first and second housings, operable for permitting the second housing to precess relative to the first housing.

2. The apparatus as recited in claim 1, wherein the first and second housings, and the bearing each have a rotational axis, and wherein the rotational axis of the second housing is permitted to precess relative to the rotational axis of the first housing.

3. The apparatus as recited in claim 2, wherein the wafer is held by the second housing perpendicular to the rotational axis of the second housing.

4. The apparatus as recited in claim 1, wherein the bearing further comprises a first cylinder having a spherical outer surface, and a second cylinder having a spherical inner surface, wherein the spherical outer surface and the spherical inner surface have substantially equal diameters with the diameter of the spherical outer surface less than the diameter of the spherical inner surface.

5. The apparatus as recited in claim 4, further comprising a friction-reducing material disposed between the spherical inner surface and the spherical outer surface.

6. The apparatus as recited in claim 4, wherein the first cylinder has a first axis, and wherein the second cylinder has a second axis, and wherein the first axis is permitted to precess relative to the second axis.

7. The apparatus as recited in claim 4, wherein the first cylinder is coupled in a fixed relationship with the first housing, and wherein the second cylinder is coupled in a fixed relationship to the second housing.

8. A semiconductor wafer polishing machine, comprising:

a platter for containing a polishing material;

a pedestal unit for holding a semiconductor wafer; and a first motor coupled to the pedestal unit for rotating the pedestal unit and the wafer, wherein a surface of the wafer is rotated in the polishing material, wherein the pedestal unit further comprises:

a first housing coupled to the first motor;

a second housing holding the wafer; and a bearing, coupled to the first and second housings, permitting the second housing to precess relative to the first housing.

9. The machine as recited in claim 8, wherein the first and second housings, and bearing each have a rotational axis, and wherein the rotational axis of the second housing is permitted to precess relative to the rotational axis of the first housing.

10. The machine as recited in claim 9, wherein the wafer is held by the second housing perpendicular to the rotational axis of the second housing.

11. The machine as recited in claim 8, wherein the bearing further comprises a first cylinder having a spherical outer surface, and a second cylinder having a spherical inner surface, wherein the spherical outer surface and the spherical inner surface have substantially equal diameters with the diameter of the spherical outer surface less than the diameter of the spherical inner surface.

12. The machine as recited in claim 11, further comprising a friction-reducing material disposed between the spherical inner surface and the spherical outer surface.

13. The machine as recited in claim 11, wherein the first cylinder has a first axis, and wherein the second cylinder has a second axis, and wherein the first axis is permitted to precess relative to the second axis.

14. The machine as recited in claim 11, wherein the first cylinder is coupled in a fixed relationship with the first housing, and wherein the second cylinder is coupled in a fixed relationship to the second housing.

15. The machine as recited in claim 11, wherein the first housing further comprises:

a tapered housing; and a torque drive ring coupled to the tapered housing, wherein the torque drive ring is coupled to the first cylinder.

16. The machine as recited in claim 15, wherein the second housing further comprises:

a bearing race clamp ring;

a bearing race support ring coupled to the bearing race clamp ring and the second cylinder;

a force transmitting housing coupled to the bearing race support ring;

a vacuum chuck disc coupled to the force transmitting housing; and an extension ring coupled to the vacuum chuck disc.

17. The machine as recited in claim 16, further comprising an elastomeric shim ring disposed between the force transmitting housing and the extension ring.

18. The machine as recited in claim 8, further comprising a vacuum motor for holding the wafer in a fixed relationship to the second housing.

* * * * *